US006417875B1

(12) United States Patent
Baker et al.

(10) Patent No.: US 6,417,875 B1
(45) **Date of Patent: *Jul. 9, 2002**

(54) ADJUSTABLE VOLTAGE FINGER DRIVER

(75) Inventors: Wm Keith Baker, Belfountain; Sotos M. Theodoulou, Bramalea, both of (CA)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/725,580

(22) Filed: Nov. 29, 2000

(51) Int. Cl.[7] ..... B41J 2/415
(52) U.S. Cl. ..... 347/128; 327/111
(58) Field of Search ..... 347/128, 142, 347/143, 144, 145, 127; 327/102, 111, 132, 140, 306, 321, 519

(56) References Cited

U.S. PATENT DOCUMENTS

| | | | | |
|---|---|---|---|---|
| 4,841,313 A | | 6/1989 | Weiner | 346/159 |
| 4,992,807 A | | 2/1991 | Thomson | 346/155 |
| 5,239,318 A | | 8/1993 | Vannerson | 346/159 |
| 5,687,001 A | * | 11/1997 | Shibuya et al. | 347/128 X |
| 5,886,723 A | | 3/1999 | Kubelik et al. | 347/120 |
| 6,015,208 A | | 1/2000 | Wakahara et al. | 347/55 |

* cited by examiner

*Primary Examiner*—Joan Pendegrass
(74) *Attorney, Agent, or Firm*—William Eipert

(57) ABSTRACT

The present invention provides a method and a circuit for driving control electrodes between a reset voltage and an adjustable extraction voltage. The circuit includes a reset switch having first and second terminals with the first terminal being connected to a high voltage source. A plurality of set switches, each capable of assuming an on state and an off state connected such that a first terminal of each set switch is connected to a corresponding one of the control electrodes and a second terminal is connected to a low voltage source. The circuit further includes a plurality of diodes, each being connected between the second terminal of the reset switch and a corresponding one of the control electrodes. A plurality of current sources, each current source being capable of assuming an enabled and a non-enabled state, are connected between a high voltage source and a corresponding one of the control electrodes to supply a constant current to the control electrodes and thereby adjust the extraction voltage at the control electrode.

16 Claims, 6 Drawing Sheets

FIG. 2
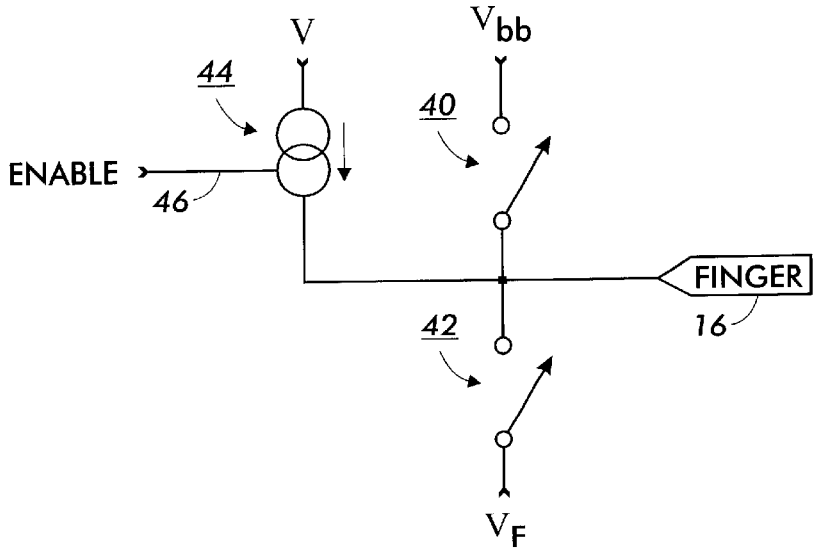
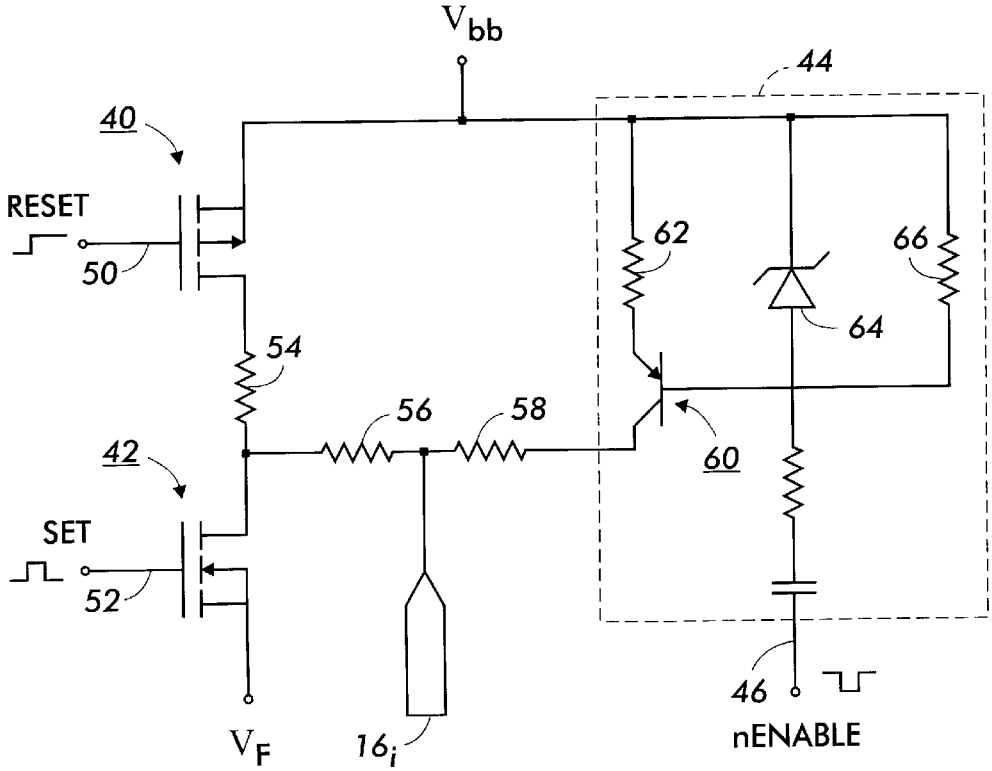
FIG. 3

ADJUSTABLE VOLTAGE FINGER DRIVER

CROSS REFERENCE

Cross reference is made to the following related patent application filed concurrently herewith: "Adjustable Voltage Finger Driver," Baker et al., application Ser. No. 09/725,531.

BACKGROUND OF THE INVENTION

The present invention relates to a device for driving a print head of an image forming apparatus. More particularly, the present invention is directed to a circuit for generating an adjustable control voltage applied to electrodes in a print head of a charge deposition printing system.

In systems for electron beam imaging and charge deposition printing, a print head having several closely spaced RF electrodes with a number of overlapping, transverse control electrodes (fingers) is commonly used to deposit charges on an imaging member. The print head may be configured to deposit either positive or negative charge, and the negative charge may consist partly or entirely of either ions or electrons. Print heads of this type are described in several U.S. Patents including, for example, U.S. Pat. Nos. 4,160,257; 4,992,807; 5,278,588; 5,159,358 and 5,315,324.

Generally in systems using this type of print head, the RF electrodes are selectively activated with a high-voltage RF drive signal which generates a localized plasma (that is, a localized charge source). The fingers, when maintained at a first potential, retain charge carriers within the charge source. Applying a control voltage to a finger electrode allows the charge carriers to escape from the charge source region at the crossing of the activated RF electrode and the finger. The charges gated from the charge source region are deposited on an imaging member, thereby forming a latent image that may be used to retain toner for transfer to a permanent recording media such as paper. By controlling the application of the high voltage RF drive signals along with the potential of the control voltage applied to the fingers, a specific pattern of charges can be deposited.

The accuracy with which the pattern of charges is deposited upon the imaging member depends, in part, upon the accuracy of the timing, duration and potential of the control voltage applied to the fingers and the accuracy of the RF signals energizing the RF electrodes. Assuming accurate application of drive signals to the RF electrodes, applying a control voltage to the individual fingers for a fixed period of time substantially co-extensive with the application of the RF drive signal produces a fixed amount of charge per activation of the finger. Varying the duration that a control voltage is applied to the finger varies the amount of charge deposited. Similarly, varying the potential applied to the finger modulates the amount of charge delivered by the print head to the imaging member. While it is necessary for some applications such as gray scale imaging to vary the total amount of charge deposited on the imaging member, any mechanism for generating and depositing charges must be precisely controlled to provide uniform imaging and ensure a faithful reproduction free of objectionable image artifacts.

Several methods and devices have been developed to precisely control the potential and timing of the control voltage supplied to finger electrodes, discussions of which can be found in U.S. Pat. Nos. 4,841,313; 4,992,807 and 5,239,318. While existing devices and methods accurately control the potential and/or timing of the voltage provided to the fingers, inherent characteristics of the print heads may limit the effectiveness of such devices. More specifically, charge deposition print heads can exhibit a significant variation in the amount of charge generated and supplied from different charge source regions (RF electrode/finger crossings) excited by the same RF drive signal and control voltage combination.

This deviation in charge output between charge source regions requires a mechanism to individually tune each charge source region output to calibrate the print head to ensure uniform imaging. Normalizing the charge source to charge source region output requires providing a specific control voltage to each finger/electrode crossing and/or supplying the control voltage for given time intervals for each finger/electrode crossing. With existing finger driver circuits, providing different control voltages to each finger requires multiple voltage supplies, each providing a specific voltage. Given the number and density of the fingers and RF electrodes which need to be tuned, a large number of voltage sources may be required making this option relatively expensive and complex. Modifying existing drivers to vary the length of time that the control voltage is applied is a rather inexpensive and simple solution to implement. However, implementing such a solution to normalize charge output with sufficient resolution in charge output to eliminate visual artifacts in the output image comes at the expense of reduced print speed (printer throughput).

SUMMARY OF THE INVENTION

In accordance with one aspect of the present invention there is provided a circuit for driving control electrodes between a reset voltage and an adjustable extraction voltage. The circuit includes a common reset switch that is capable of being set to an 'ON' state and an 'OFF' state and that includes first and second terminals with the first terminal being connected to a high voltage source. A plurality of set switches, each being capable of assuming an on state and an off state and each including first and second terminals, are connected such that the first terminal of each set switch is connected to a corresponding one of the control electrodes and the second terminal is connected to a low voltage source. The circuit further includes a plurality of diodes, each being connected between the second terminal of the common reset switch and a corresponding control electrode. A plurality of current sources, each current source being capable of independently assuming an enabled and a non-enabled state, are connected between a high voltage source and a corresponding one of the control electrodes to supply a constant current to the control electrodes and thereby adjust the extraction voltage at the control electrode.

In accordance with another aspect of the present invention there is provided a method for driving a print head of an image forming device. The method includes (a) setting the voltage at electrodes in the print head to a nonprinting potential; (b) setting the voltage at a plurality of the electrodes to a first printing potential; and (c) charging selected ones of the plurality of the electrodes with a current source to adjust the potential at the selected electrodes to a final printing potential.

In accordance with another aspect of the present invention there is provided an imaging device including a dielectric imaging member; a print head positioned to deposit charge on the imaging member, the print head including a plurality of RF electrodes and a plurality of control electrodes; an RF driver connected to the plurality of RF electrodes, the RF driver supplying an RF voltage to the RF electrodes; and a circuit connected to the plurality of control electrodes, the circuit driving selected control electrodes between a reset voltage and an adjustable control voltage. The circuit includes a reset switch being capable of assuming a first state and a second state, the reset switch including a first terminal connected to a first voltage source; a plurality of set switches, each set switch having the capability of assuming a first state and a second state, each set switch including a first terminal connected to a second voltage source and a second terminal connected to a corresponding one of the control electrodes; a plurality of diodes, each one of the plurality of diodes connected between a second terminal of the reset switch and a corresponding one of the control electrodes; and a plurality of current sources, each current source being capable of assuming an enabled and a non-enabled state, each current source being connected to a third voltage source and a corresponding one of the control electrodes.

BRIEF DESCRIPTION OF THE DRAWINGS

FIG. 2 illustrates an embodiment of an adjustable voltage finger driver in accordance with the present invention;

FIG. 3 shows an embodiment of a adjustable voltage finger driver circuit in accordance with the teachings of the present invention;

DETAILED DESCRIPTION OF THE INVENTION

Figure 1:
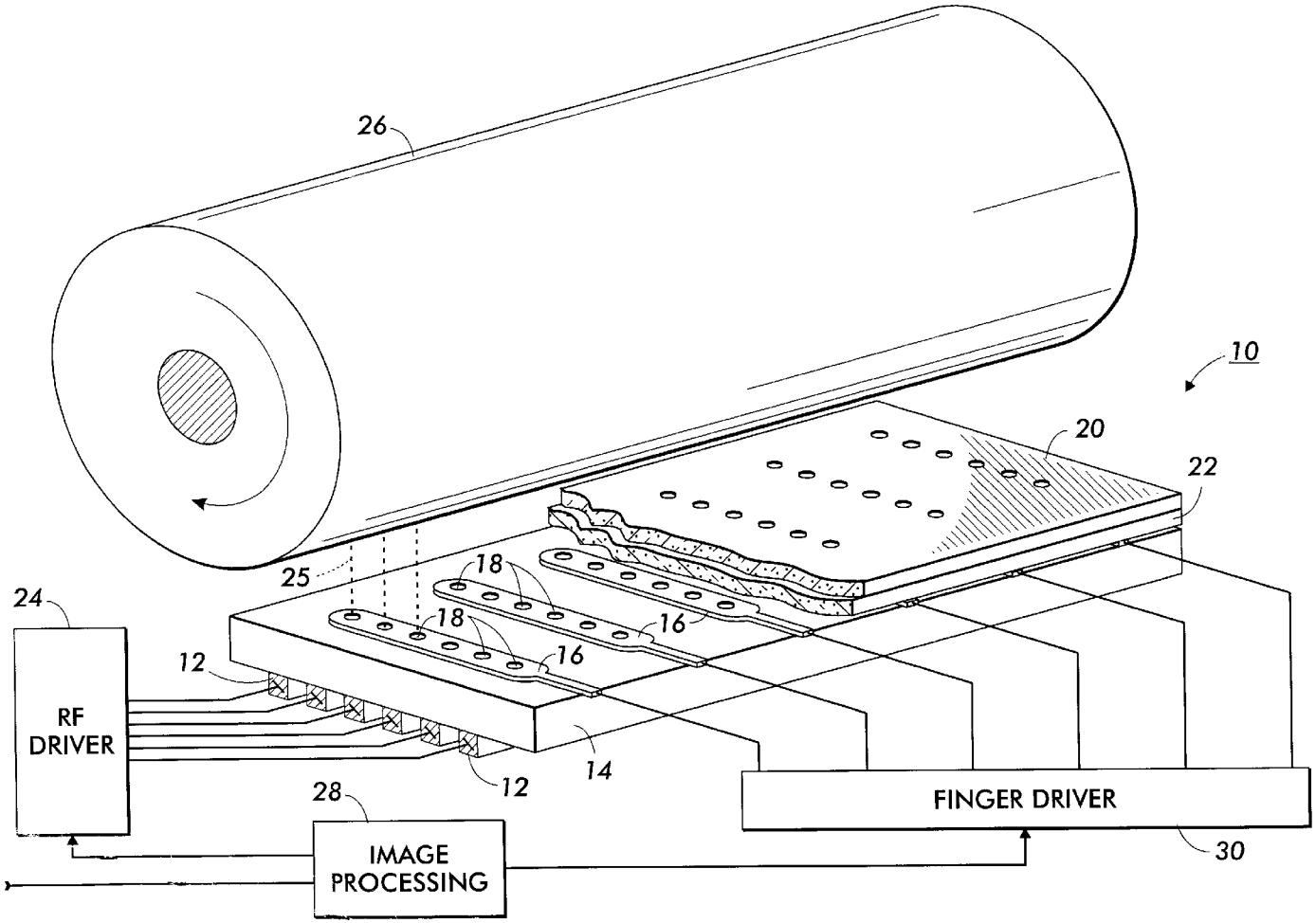
FIG. 1 illustrates an imaging device including a charge deposition print head suitable for use with a finger driver of the present invention.

The following will be a detailed description of the drawings which are given for purposes of illustrating the preferred embodiments of the present invention, and not for purposes of limiting the same. In this description, as well as in the drawings, like reference numbers represent like devices, circuits, or circuits performing equivalent functions.

To begin by way of general explanation, FIG. 1 shows a schematic representation of an electrographic latent imaging device including a print cartridge 10 that may be driven by a finger driver in accordance with the present invention. Cartridge 10 includes a plurality of individual corona generating RF electrodes 12 extending along the length of the cartridge with a dielectric layer 14 over the electrodes. A plurality of control electrodes (fingers) 16 are located on the dielectric layer. Each finger 16 includes a plurality of small holes 18, with each hole being aligned over one of the RF electrodes 12 and defining local charge source region. In an alternative construction, one or more elongated holes or slots may replace the plurality of holes in a finger. In such an embodiment, each slot is located over several electrodes. The fingers are oriented obliquely to the RF electrodes, so that the nominal dot spacing achieved in this manner is equal to the pitch of the finger electrode divided by the number of RF electrodes. A further option for inclusion in cartridge 10 is a screen electrode 20 separated from the fingers by a spacer 22. The screen electrode and spacer are optional because the RF electrodes 12 and fingers 16 provide a charge imaging matrix; however in some applications print quality may be enhanced by the use of a screen electrode.

An RF driver 24 provides high frequency, high voltage RF signals in a timed relation to each of the RF electrodes 12. Finger driver 30 provides timed bias voltage signals to fingers 16 to drive the fingers between different potentials to selectively retrain emit charge carriers 25 from a charge source region defined by the finger electrode and actuated RF electrode passing transversely below it. The emitted charge carriers 25 are deposited on imaging member 26 such as a drum or belt thereby forming a latent image that can then be used to retain toner for transfer to a permanent recording media such as paper.

Given the electrode geometry described above, dots with different horizontal offsets are generated by different RF electrodes. Thus, image encoding and timing control are necessary to activate the different electrodes and fingers in an appropriate order to print a straight line or a geometrically correct image. This control function is accomplished by deskew processor 28 which provides synchronizing, RF electrode selection and finger control signals to effect the particular order and timing offset of the various electrode driving signals necessary to compensate for the oblique electrode geometry of the print cartridge, and to print geometrically correct images. Specifically, deskew processor 28 receives image data representing an image to be printed, identifies the RF line electrode and finger combinations necessary to effectuate the output image, and provides timed signals to the RF driver 24 and finger driver 30 that identify the fingers to be activated for each selected RF electrode selected.

Turning now to FIG. 2, there is shown a basic circuit for an embodiment of an adjustable voltage finger driver circuit according with the teachings of the present invention. The finger driver of FIG. 2 controls the potential applied to finger 16 to vary between a nonprinting state and a printing state by closing either reset switch 40 or set switch 42. Additionally, the finger driver includes current source 44 responsive to control signal 46. Enabling current source 44 charges finger 16, which is a capacitive load $C_f$, with a constant current causing the control voltage at the finger to increase.

More specifically, finger 16 is maintained in a nonprinting state by closing reset switch 40 (with set switch 42 open) to hold the finger potential at a back-bias voltage $V_{bb}$ which retains the charge carriers. Opening switch 40 and closing set switch 42 sets the voltage on finger 16 to an initial finger control voltage $V_F$ which corresponds to the potential that provides maximum charge output from the finger. Set switch 42 is then opened and, with switches 40 and 42 open, current source 44 is enabled thereby providing a constant current source charging finger 16 causing the control voltage on the finger to ramp up. As the control voltage on finger 16 ramps up from $V_F$ toward $V_{bb}$, the charge output from the finger decreases. The magnitude of the voltage ramp up at the finger is a function of the magnitude of current supplied to the finger, the load capacitance $C_f$, and the length of time that the current source is charging the finger. By controlling the current flow and/or the length of time that the current source is enabled, it is possible to precisely adjust the control voltage applied to the finger and thereby regulate the charge output by a given finger for each RF burst. However, as will be appreciated, it is more convenient to fix either the current flow or the time of current injection in order to reduce the search for an 'optimal' to a one-dimensional search as opposed to two-dimensions. Specifically, this mechanism starts the finger printing at a maximum darkness (for a given $V_F$) and squelches charge output by ramping the finger voltage towards $V_{bb}$.

Referring to FIG. 3, there is shown a circuit diagram detailing the components within the embodiment of finger driver associated with driving a single finger 16. In the embodiment of FIG. 3, the potential of finger 16 is varied between the nonprinting state potential $V_{bb}$ and the initial finger potential of the printing state, control voltage $V_F$, by a pair of semiconductor switches 40 and 42 operating as the reset and set switches respectively. For purposes of illustration, semiconductor switches 40 and 42 are shown as comprising and referred to as MOSFETs 40 and 42. However, it is understood that the reset and set switches can embody any electrical, mechanical, electromechanical or semiconductor device capable of selectively applying the nonprinting state potential $V_{bb}$ to finger 16. Furthermore, it should be understood that the reset and set switches need not embody the same type of switching device.

Reset switch 40 is enabled or disabled (turned on or off) by reset signal 50, and when enabled, the switch conducts to reset the finger potential to the back-bias voltage $V_{bb}$. Set switch 42 is similarly operated in response to set signal 52. That is, switch 42 is enabled to set the potential at finger 16 to the initial finger control voltage $V_F$. An optional resistor 54 can be added to provide an impedance between the drains of MOSFETs 40 and 42 to limit current flow between the two and thereby prevent current shoot-through in the event both transistors conduct at the same time (typically, the enablement of switches 40 and 42 are mutually exclusive). Resistors 56 and 58 are included to dissipate the energy associated with the charging and discharging of the capacitance, $C_f$, of finger 16.

As discussed above, finger 16 is further driven by current source 44 which, responsive to a current source enable signal 46, charges the finger with a constant current causing the control voltage at the finger to increase. In the embodiment shown, current source 44 comprises (pnp) transistor 60 with its collector connected to the finger and its emitter connected to voltage source $V_{bb}$ through resistor 62. Transistor 60 is controlled by enable signal 46 connected to the base of the transistor. It will be noted that in the embodiment of FIG. 3 enable signal 46 is identified as nEnable to indicate that the signal is active low.

Current source 44 also includes zener diode 64 connected between transistor 60 and the voltage source $V_{bb}$ with the anode of the diode connected to the base of the transistor. The values of zener diode 64 and resistor 62 are selected to generate the desired current for charging the finger capacitance, $C_f$. That is, the breakdown voltage of zener diode 64 sets a total voltage drop across resister 62 and base-emitter junction, thereby setting the current flow through resistor 62 to the emitter of transistor 60. The current source can further include an optional resistor 66 connected between the base of base of transistor 60 and the voltage source $V_{bb}$ in parallel with diode 64. Resistor 66 operates to ensure transistor 60 turns off after the application of enable signal 46.

Figure 4:
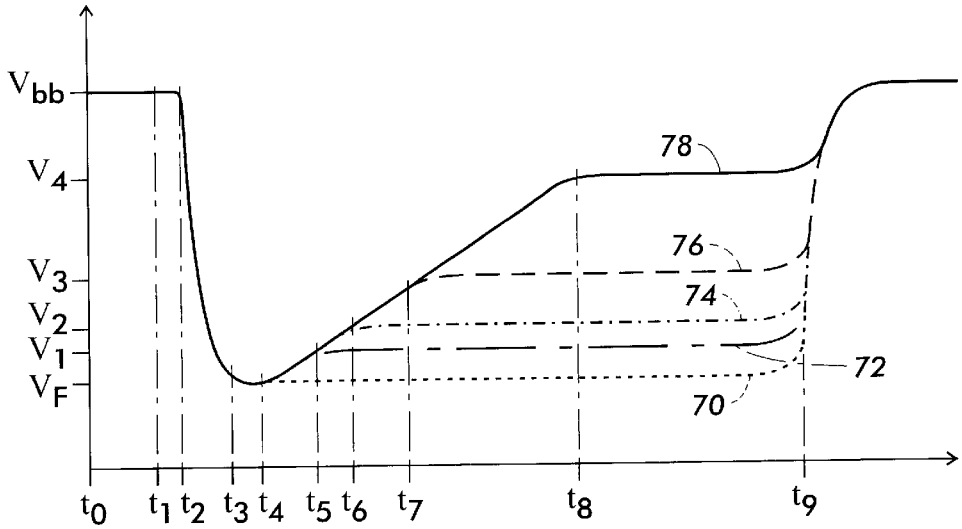
FIG. 4 is a graph illustrating voltage over time at a finger driven by an adjustable voltage finger driver in accordance with the teachings of the present invention.
Figure 5:
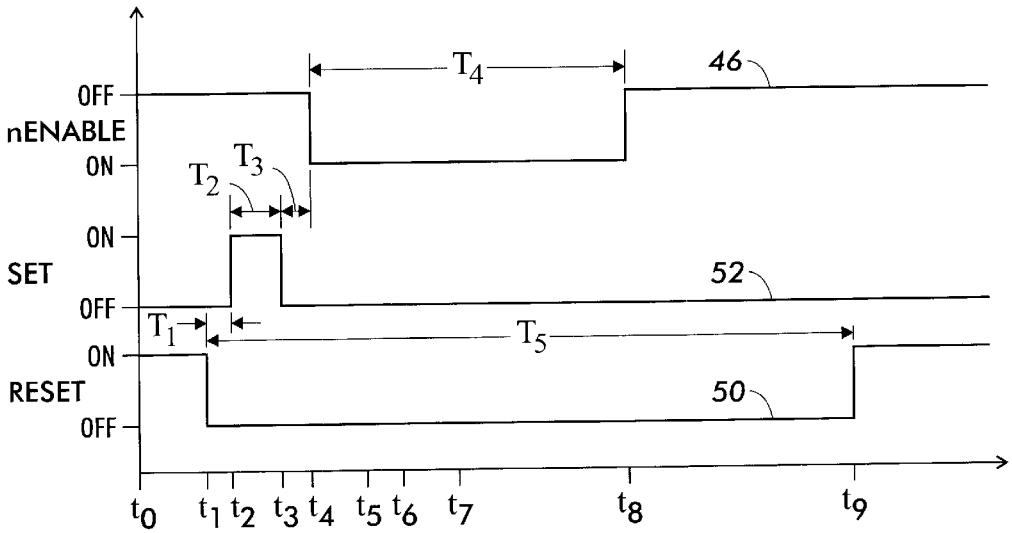
FIG. 5 is a chart illustrating the application of the reset, set and current enable signals in the operation of an adjustable voltage finger driver.

The operation of the adjustable voltage finger driver of FIG. 3 will be described with additional reference to FIGS. 4 and 5. FIG. 4 shows a graph illustrating the finger voltage over time for various enable period of the current source. FIG. 5 illustrates the timing of the application of the reset, set and current enable signals for a charge deposition cycle as well as the states of reset, set and current enable signals which correspond to the states of MOSFET 40, MOSFET 42 and transistor 60, respectively. In an initial state, at time $t_0$, MOSFET 40 is made active by reset signal 50 resulting in voltage $V_{bb}$ being applied to the finger. At time $t_0$, set signal 52 and current enable signal 46 (nEnable) are off. At time $t_1$, reset signal 50 turns MOSFET 40 off which is followed by the turning on of MOSFET 42 at time $t_2$. The delay $T_1$ between the turning MOSFET 40 off and turning MOSFET 42 on should be minimized to reduce the total deposition cycle time and thereby increase the print speed. However, the period $T_1$ must be long enough to ensure that the charge at the finger will be brought to $V_{bb}$.

Turning MOSFET 42 on in response to signal 52 sets the initial control voltage at finger 16 to the $V_F$ potential corresponding to the maximum charge output. Beneficially, the period $T_2$ that MOSFET 42 is on is equal to time that it takes for the finger to reach the potential $V_F$ after which the set signal is turned off at time $t_3$. After a lapse of time $T_3$, nEnable signal 46 goes low to activate transistor 60 (at time $t_4$) which generates a constant current charging finger 16 causing the voltage on the finger to ramp up. The delay $T_3$ between turning off MOSFET 42 and activating transistor 60 beneficially is kept small to maximize the time available to adjust the finger voltage and thereby maximize resolution.

The control voltage at finger 16 is equal to $V_F$ at time $t_3$. After the current source is enabled at $t_4$, the control voltage on begins to increase in response to the charging current supplied from transistor 60 and continues to rise until the current source is turned off at time $t_8$. The magnitude and rate of the voltage ramp up at the finger is a function of the value of the current supply and the length of time that the current source is charging the finger. After the current source is turned off, the finger potential will remain substantially constant at the level reached at the time the current source was turned off until the application of reset signal 50 turns on MOSFET 40 thereby pulling the finger back to $V_{bb}$, as illustrated at time $t_9$. The time period $T_5$ that selected fingers remain in the printing stage before MOSFET 40 is turned on is determined by the time necessary to deposit charge on the imaging surface and is based, in part, upon the characteristics of RF signal burst (e.g., frequency, amplitude, waveform, timing, etc.).

FIG. 4 further illustrates the different control voltages obtained at finger 16 for various periods of time that the current source is enabled. Specifically, plots 70, 72, 74, 76 and 78 show the finger control voltage for a current source enable period $T_4$ equal to 0, 1/16, 1/8, 1/4 and 1/2 of the period T5-(T1+T2) that the current source may be active corresponding to times $t_4$, $t_5$, $t_6$, $t_7$ and $t_8$, respectively. That is, that the control voltage can be maintained at $V_F$ by simply not enabling the current source.

Although not shown in the figures, the timing of the application of the RF burst to the RF electrodes crossing the fingers will be briefly discussed. The RF burst can be applied at any time during the cycle illustrated in FIG. 5. Applying the RF burst after the finger has reached the final control voltage (i.e., after the current source is turned off) provides the advantage of having a constant, precisely controlled voltage at each finger during the burst. However, this advantage comes at the cost of slower print speed caused by having to delay the application of the burst until the last finger voltage is set. The RF burst is beneficially applied with the activation of the set transistor. Typically, the finger is turned to the 'On' state at the same time as the start of the RF burst. The current source can be turned on at the same time as the start of the RF burst; however, it is prudent to wait until the set transistor is off before enabling the current source to minimize the power dissipation in said current source.

Figure 6:
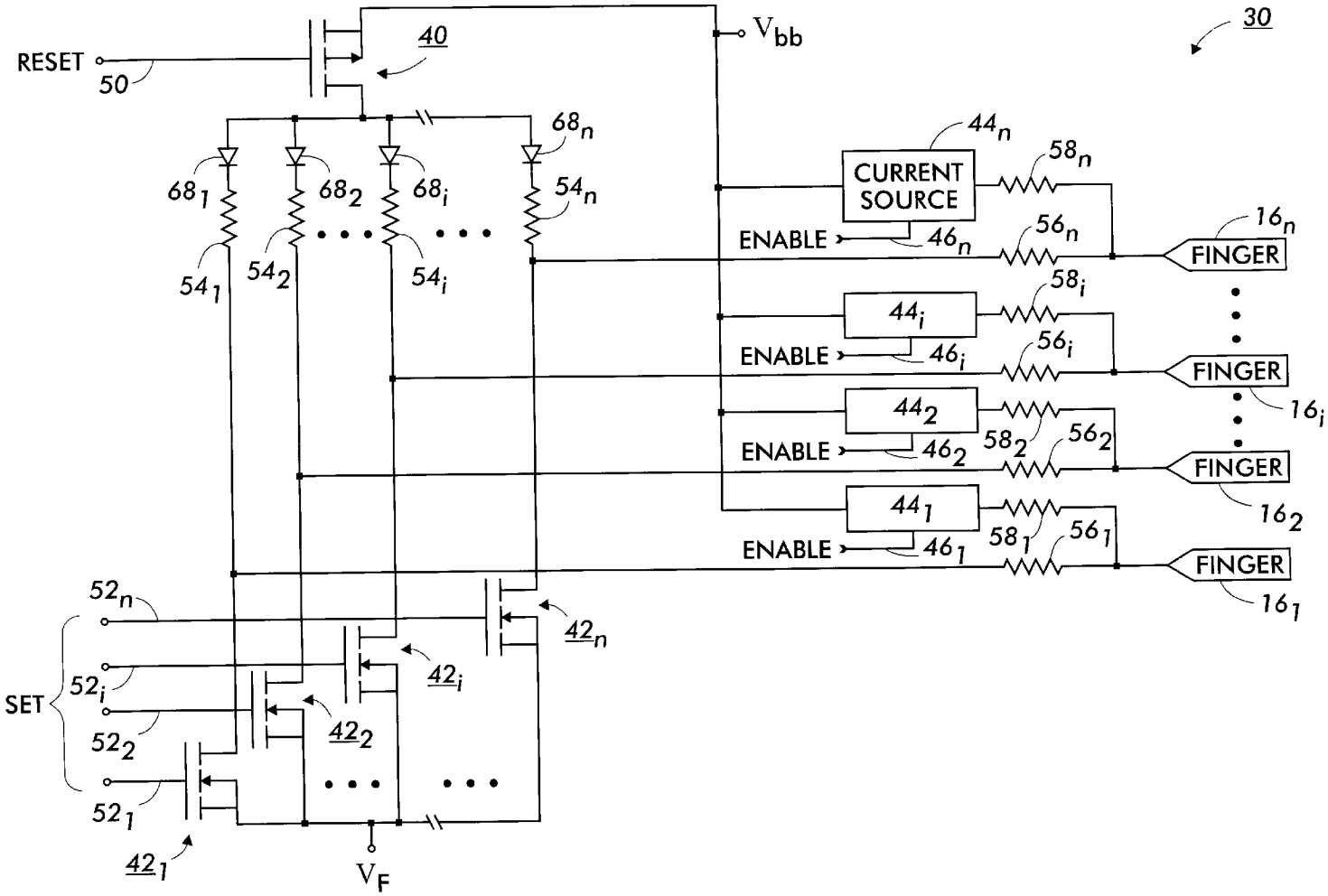
FIG. 6 is a circuit diagram showing an embodiment of a adjustable voltage finger driver according to the present invention.

FIG. 6 shows an embodiment of an adjustable voltage finger driver 30 for driving a cartridge in accordance with the present invention. In the driver of FIG. 6, each finger $\mathbf{16}_i$ of a plurality of fingers i=1, . . . N, is connected to a corresponding set switch (shown as MOSFET $\mathbf{42}_i$) which operates to selectively supply an initial control voltage $V_F$ to the finger. MOSFET $\mathbf{42}_i$ is turned on in response to a set signal $\mathbf{52}_i$ to thereby set the initial control voltage at finger $\mathbf{16}_i$ to $V_F$. The plurality of set signals $\mathbf{52}_i$ (i=1, . . . N) are beneficially supplied in parallel from a field programmable gate array (FPGA), latch or similar control device such that the designated transistors are turned on at substantially the same time.

Each finger $\mathbf{16}_i$ is further connected to a common reset switch 40 to reset the fingers to a nonprinting state by setting the potential at the fingers to the back-bias voltage $V_{bb}$. In FIG. 6, reset switch 40 is shown realized with a single MOSFET common to all the fingers through a respective series combination of resistor $\mathbf{54}_i$ and diode $\mathbf{68}_i$. In this manner, when MOSFET 40 is turned on in response reset signal 50, the MOSFET conducts and thereby pulls all the fingers up to $V_{bb}$. The diodes serve to isolate each finger from all other fingers, and resistors $\mathbf{54}_i$, as discussed above, are optional components to protect against a current shoot-through.

As discussed above, each finger $\mathbf{16}_i$ is further driven by its own current source $\mathbf{44}_i$, which responsive to control signal $\mathbf{46}_i$, charges the finger with a constant current causing the control voltage at the finger to increase. The magnitude of the voltage increase is a function of the length of time that the current source is charging the finger. Resistors $\mathbf{56}_i$ and $\mathbf{58}_i$ are included to dissipate the energy associated with charging and discharging the capacitance of finger $\mathbf{16}_i$.

In operation, the activation of the reset, set and enable signals will follow the timed relation described above in reference to FIGS. 4 and 5. That is, finger driver of FIG. 6 will initially set all fingers to a nonprinting state by turning on MOSFET 40 to set the potential at each finger to $V_{bb}$. Next, selected fingers will be set to an initial control voltage of $V_F$ by activation of the corresponding MOSFETs $\mathbf{42}_i$. After the potential of the selected fingers is set to $V_F$, the respective MOSFETs are turned off and the current sources $\mathbf{44}_i$ are enabled. The specific period of time that each current source $\mathbf{44}_i$ is enabled can be determined through a calibration procedure to determine the amount of charge generated in relation to enable signal period. A simple calibration method would print a set of dots, each dot being generated with a several different current source on times (i.e., enable signal periods) and determine the optimal period which can then be stored in a printer's firmware.

Figure 7:
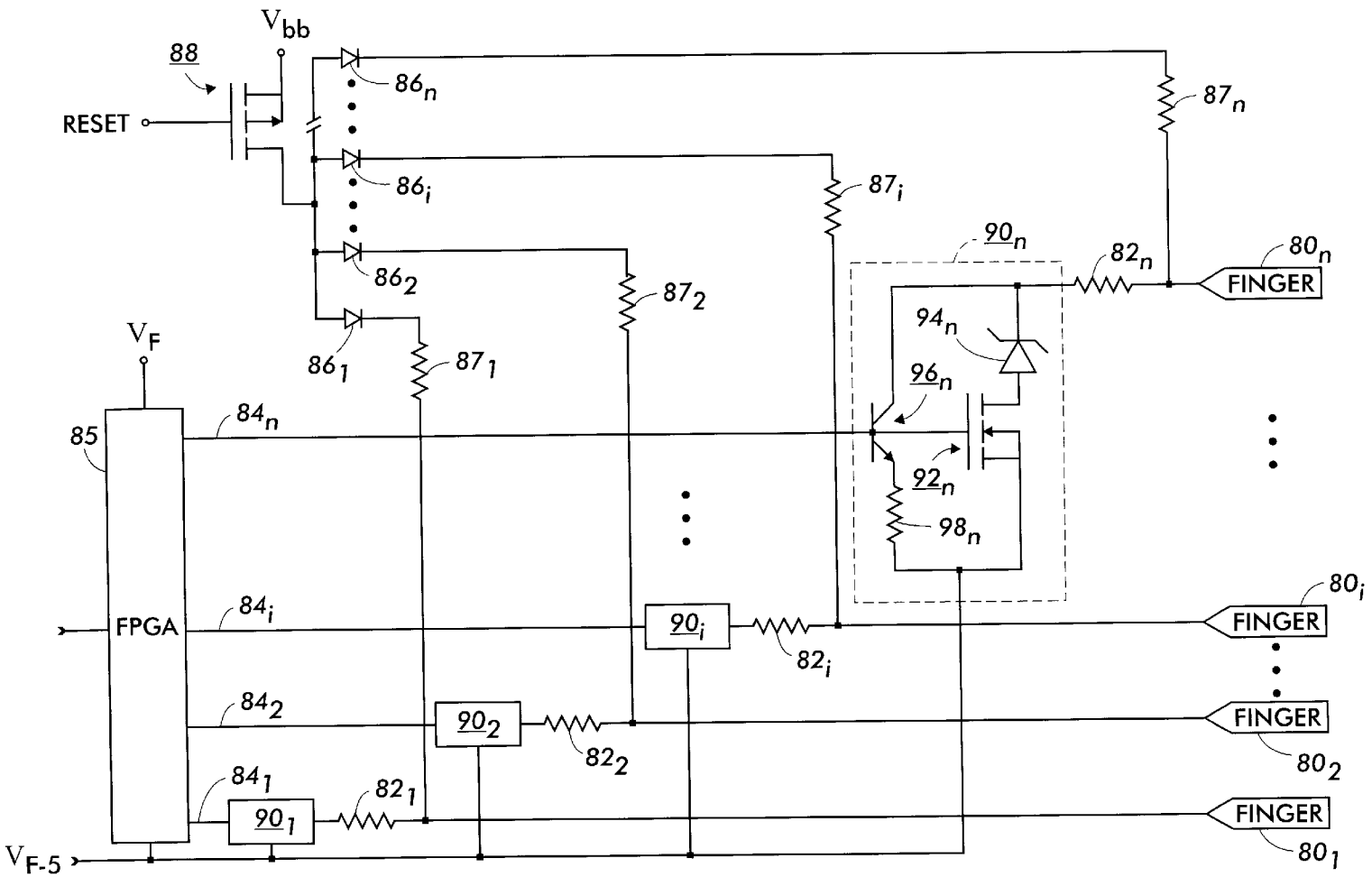
FIG. 7 is a circuit diagram showing a second embodiment of an adjustable voltage finger driver according to the present invention.

Turning now to FIG. 7, there is shown another embodiment of an adjustable voltage finger driver 30 for driving a cartridge in accordance with the present invention. In this embodiment, each of a plurality of fingers $\mathbf{80}_i$ (i=1, . . . N) is connected to a corresponding one of the voltage control switches $\mathbf{90}_i$ through a respective resistor $\mathbf{82}_i$. Each voltage control switch $\mathbf{90}_i$ is controlled by a corresponding control signal $\mathbf{84}_i$ to establish a desired control voltage at the designated finger $\mathbf{80}_i$. Beneficially the control signals $\mathbf{84}_i$ are received in parallel from FPGA 85 or a similar device such that the designated voltage control switches $\mathbf{90}_i$ are activated at substantially the same time.

Each finger $\mathbf{80}_i$ is further connected to a common reset switch 88 to reset the potential at each of the fingers $\mathbf{80}_i$ to the reset voltage $V_{bb}$ corresponding to a nonprinting state. Reset switch 88 can embody any available switching device including electric, mechanical, electromechanical, semiconductor, etc. In the embodiment of FIG. 7, reset switch 88 embodies a single MOSFET which is connected to all the fingers through respective diode $\mathbf{86}_i$ and resistor $\mathbf{87}_i$ pair (i=1, . . . N). As above, the diodes serve to isolate each finger from all other fingers while the resistors are optional components to protect against a current shoot-through.

In this embodiment, voltage control switch $\mathbf{90}_i$ operates to regulate the charge output at finger $\mathbf{80}_i$ by quickly bringing the control voltage at the finger from the nonprinting state potential $V_{bb}$ to an initial control voltage $V_{F+\Delta}$ (beneficially the minimum voltage required to deposit charge) when the switch $\mathbf{90}_i$ is enabled. After the finger reaches the initial control voltage, the voltage control switch operates to slowly drive down the potential at the finger towards voltage $V_F$ corresponding to maximum charge output. This operation can be performed using a current sink in parallel with a switched voltage source that supplies the initial voltage.

One embodiment of voltage control switch $\mathbf{90}_N$ for finger $\mathbf{80}_N$ is illustrated in detail. In voltage control switch $\mathbf{90}_N$, the voltage source is achieved with switch that stops conducting at the initial voltage and is shown comprising transistor 92 or similar switching device with the drain connected to the anode of Zener diode 94 and the source connected to a supply voltage equal to the maximum control voltage $V_F$. A current sink, connected across MOSFET $\mathbf{92}_N$ and zener diode $\mathbf{94}_N$, is shown comprising transistor $\mathbf{96}_N$ with resistor $\mathbf{98}_N$ connected to its emitter. More specifically, the collector of transistor $\mathbf{96}_N$ is connected to the cathode of zener diode $\mathbf{94}_N$ and resistor $\mathbf{98}_N$ is connected the source of MOSFET $\mathbf{92}_N$. Transistor $\mathbf{96}_N$ and MOSFET $\mathbf{92}_N$ are controlled (activated and deactivated) in response to control signal $\mathbf{84}_N$ connected to the base of transistor $\mathbf{96}_N$ and the collector of MOSFET $\mathbf{92}_N$. It should be appreciated that the semiconductor switches can comprise any semiconductor switch (e.g., either bipolar or mosfet) as well as any other switching device including an electrical, mechanical or electromechanical device.

Figure 8:
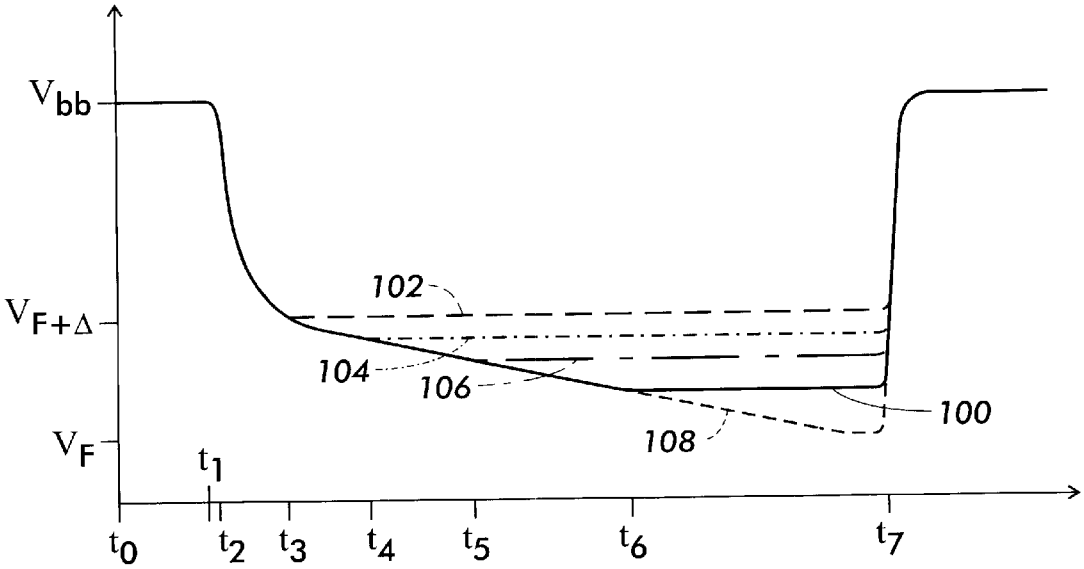
FIG. 8 illustrates the voltage over time for a finger driven by an adjustable voltage finger driver in accordance with the present invention.

The operation of the adjustable voltage finger driver of FIG. 7 will be described with additional reference to FIGS. 8 and 9 which illustrate finger voltage over time and the timing of the application of the reset and control signals, respectively. At time $t_0$, reset switch 88 is closed (e.g., the MOSFET is active) resulting in voltage $V_{bb}$ being applied to each of the fingers $\mathbf{80}_i$ (i=1, . . . N). At time $t_0$, each voltage control switch $\mathbf{90}_N$ is turned off. At time $t_1$, the reset signal turns off thereby opening reset switch 88. This is followed by the activation of selected voltage control switches $\mathbf{90}_i$ with corresponding control signals $\mathbf{84}_i$ at time $t_2$.

At time $t_2$ the finger capacitance begins to rapidly discharge to an initial control voltage of $V_{F+\Delta}$ which is determined by the breakdown voltage of the zener diode. The rapid discharge is competed by time $t_3$, at which point the finger capacitance is slowly discharged for an adjustable period of time by a current sink. After the voltage control switch is turned off, time $t_6$ in the illustrated example, the finger will retain its current control voltage until reset to $V_{bb}$ by activation of reset switch 88 at $t_7$. By adjusting the time that the control signal is active, the control voltage at a finger can be precisely set.

Specifically, a pulse width modulated control signal $84_N$ is supplied to the base of transistor $96_N$ and the collector of MOSFET $92_N$ to thereby enable or disable the current sink and the MOSFET. When the control sign is made active, both MOSFET $92_N$ and the current sink (transistor $96_N$) are enabled. With MOSFET $92_N$ enabled, zener diode $94_N$ conducts a large current causing the finger capacitance to quickly discharge to the zener breakdown thereby setting the initial control voltage $V_{F+\Delta}$ on the finger.

When the potential of the finger reaches the zener breakdown potential, as shown at time $t_3$, zener $94_N$ stops conducting. The finger capacitance will continue to discharge, thus lowering the control voltage, through the current sink until the current sink is disabled, i.e., until the control signal goes low. In the example operation shown, the current sink is enabled (the control signal is active) for the period of time T2 from $t_2$ to $t_6$. After the voltage control switch is turned off, time $t_6$ in the illustrated example, the finger remains at the current control voltage, as illustrated by plot 100, until the application of the reset signal closes reset switch 88 (enables on MOSFET 88) thereby pulling the finger back to $V_{bb}$, as illustrated at time $t_7$.

Figure 9:
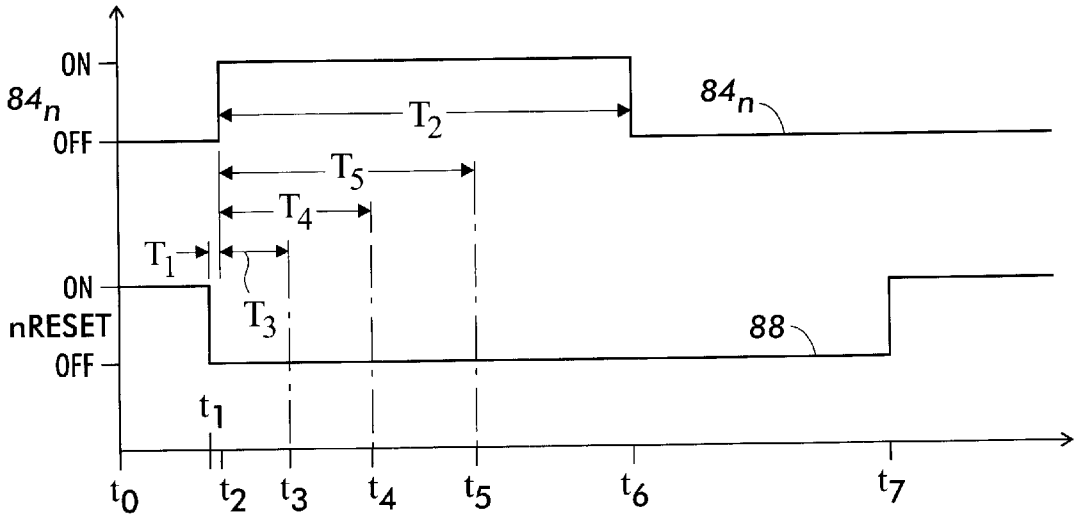
FIG. 9 is a timing chart illustrating the operation of an adjustable voltage finger driver.

As can be seen from FIG. 9, adjusting the time that the current sink is active, changes the final control voltage set at a finger. Specifically, plots 102, 104, and 106 show the finger control voltage for a control signal periods T3, T4, and T5 corresponding to deactivating the voltage control switch at times $t_3$, $t_4$ and $t_5$, respectively. As can be further seen in FIG. 9, if the voltage control switch can be activated for the entire period from $t_2$ to $t_7$, the control voltage will continue to fall until a maximum control voltage $V_F$ is reached at which point the control voltage remains at $V_F$ until the voltage control switch is deactivated.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A circuit for driving control electrodes between a reset voltage and a control voltage, the control voltage being adjustable at each control electrode, comprising:

a reset switch being capable of assuming a first state and a second state, the reset switch including first and second terminals, the first terminal being connected to a first voltage source;

a plurality of set switches, each set switch having the capability of assuming a first state and a second state, each set switch including first and second terminals, the first terminal being connected to a second voltage source, and the second terminal being connected to a corresponding one of the control electrodes;

a plurality of diodes, each one of the plurality of diodes connected between the second terminal of the reset switch and a corresponding one of the control electrodes; and a plurality of current sources, each current source being capable of assuming an enabled and a non-enabled state, each current source being connected to a third voltage source and a corresponding one of the control electrodes.

2. The circuit of claim 1, wherein selected ones of the plurality of current sources each comprise:

a transistor having a base, an emitter and a collector, the collector being connected to the corresponding electrode;

a resistor connected between the emitter and the third voltage source; and a zener diode connected between the base and the third voltage source.

3. The circuit of claim 2, wherein the selected ones of the plurality of current sources each further comprise a resistor connected between the base and the third voltage source.

4. The circuit of claim 1, wherein the first and third voltage sources are the same.

5. The circuit of claim 1, wherein placing a set switch into the first state for a first time period to supplies an initial control voltage to the corresponding control electrode and enabling the current source for second time period adjusts the control voltage at the corresponding control electrode.

6. The circuit of claim 5, wherein the reset voltage is supplied to the plurality of control electrodes by placing the reset switch in the first state.

7. The circuit of claim 1, wherein:

the reset switch comprises a semiconductor switch; and each of the set switches comprises semiconductor switch.

8. The circuit of claim 1, further comprising a set of resistors connected to selected ones of the control electrodes, each set of resistors including a first resistor connected between the electrode and the current source and a second resistor connected between the electrode and the second terminal of the corresponding set switch.

9. A method for driving a print head of an image forming device, comprising:

(a) setting the voltage at electrodes in the print head to a nonprinting potential;

(b) setting the voltage at a plurality of the electrodes to a first printing potential; and (c) charging selected ones of the plurality of the electrodes with a current source, the charging step comprising (c1) using a first current source to supply a current to a first electrode for a first period of time and (c2) using a second current source to supply a current to a second electrode for a second period of time.

10. The method according to claim 9, further comprising:

(d) supplying an RF voltage to an RF electrode within the print head.

11. The method according to claim 9, wherein step (c1) supplies a substantially constant current to the first electrode.

12. The method according to claim 9, wherein steps (c1) and (c2) are initiated substantially simultaneously.

13. An imaging device, comprising:

a dielectric imaging member;

a print head positioned to deposit charge on the imaging member, the print head including a plurality of RF electrodes and a plurality of control electrodes;

an RF driver connected to the plurality of RF electrodes, the RF driver supplying an RF voltage to the RF electrodes; and a circuit connected to the plurality of control electrodes, the circuit driving selected control electrodes between a reset voltage and an adjustable control voltage, the circuit including a reset switch being capable of assuming a first state and a second state, the reset switch including a first terminal connected to a first voltage source;

a plurality of set switches, each set switch having the capability of assuming a first state and a second state, each set switch including a first terminal connected to a second voltage source and a second terminal connected to a corresponding one of the control electrodes;

a plurality of diodes, each one of the plurality of diodes connected between a second terminal of the reset switch and a corresponding one of the control electrodes; and a plurality of current sources, each current source being capable of assuming an enabled and a non-enabled state, each current source being connected to a third voltage source and a corresponding one of the control electrodes.

14. The imaging device of claim 13, wherein selected ones of the plurality of current sources each comprise:

a transistor having a base, an emitter and a collector, the collector being connected to the corresponding electrode;

a resistor connected between the emitter and the third voltage source; and a zener diode connected between the base and the third voltage source.

15. The imaging device of claim 14, wherein placing a set switch into the first state for a first time period to supplies an initial control voltage to the corresponding control electrode and enabling the current source for second time period adjusts the control voltage at the corresponding control electrode.

16. The imaging device of claim 14, wherein:

the reset switch comprises a semiconductor switch; and each of the set switches comprises semiconductor switch.

* * * * *